US006763808B2

(12) United States Patent
Ryuzaki

(10) Patent No.: US 6,763,808 B2
(45) Date of Patent: Jul. 20, 2004

(54) FUEL PUMP AND FUEL FEEDING DEVICE USING THE FUEL PUMP

(75) Inventor: Koutaro Ryuzaki, Higashimatsuyama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 0 days.

(21) Appl. No.: 10/221,022

(22) PCT Filed: Feb. 7, 2001

(86) PCT No.: PCT/JP01/00844

§ 371 (c)(1),
(2), (4) Date: Sep. 9, 2002

(87) PCT Pub. No.: WO01/69075

PCT Pub. Date: Sep. 20, 2001

(65) Prior Publication Data

US 2003/0029424 A1 Feb. 13, 2003

(30) Foreign Application Priority Data

Mar. 14, 2000 (JP) ..... 2000-69946

(51) Int. Cl.[7] ..... F02M 37/04

(52) U.S. Cl. ..... 123/446; 123/495; 123/467; 417/216

(58) Field of Search ..... 123/446, 456, 123/495, 467, 496; 417/216, 217, 218, 222.1

(56) References Cited

U.S. PATENT DOCUMENTS 5,058,553 A * 10/1991 Kondo et al. ..... 123/456
5,277,156 A * 1/1994 Osuka et al. ..... 123/198 DB
5,823,168 A * 10/1998 Otoh et al. ..... 123/496
5,983,863 A * 11/1999 Cavanagh et al. ..... 123/447
6,095,118 A * 8/2000 Klinger et al. ..... 123/446

FOREIGN PATENT DOCUMENTS

JP 1-267356 10/1989
JP 11-62763 3/1999

* cited by examiner

*Primary Examiner*—Carl S. Miller
(74) *Attorney, Agent, or Firm*—Wenderoth, Lind & Ponack L.L.P.

(57) ABSTRACT

A fuel injection pump includes a plurality of plungers and a cam shaft having a plurality of drive cams (31, 32) corresponding to the plungers. The cam shaft is rotated by a power from the outside so as to reciprocate the plurality of plungers by the corresponding drive cams, and fuel is pressurized and force-fed in the forward stroke of each plunger. All or a part of the drive cams (31, 32) are installed with the phase thereof shifted, and the cam lobes **(31*a*, 32*a*)** of the drive cams are formed asymmetrical so that the amount of displacement of the plungers relative to a unit cam rotating angle is reduced in the forward stroke more than in the backward stroke of the plunger. Thus, the pressure variation in a common rail is reduced, the pressure resistance of the entire system is lowered, and the drive torque is reduced so as to reduce the load and noise of a drive system.

20 Claims, 7 Drawing Sheets

1
2
3
4
5
6
7
8
10
11
12
13
14
15
ECU
VRIOUS INFORMATION SIGNALS

FUEL PUMP AND FUEL FEEDING DEVICE USING THE FUEL PUMP

TECHNICAL FIELD

The present invention relates to a fuel pump comprising a plurality of plungers and a camshaft having a plurality of drive cams. Each of the drive cams corresponds to one of the plungers, and the camshaft with the drive cams engages the plungers in reciprocal movement by rotating the camshaft. The present invention also relates to a fuel feeding device that employs this fuel pump.

BACKGROUND ART

A fuel feeding device adopting the so-called common rail system comprises a fuel pump, a common rail in which high-pressure fuel force-fed from the fuel pump is stored, and fuel injection valves each provided in correspondence to one of the cylinders of an internal combustion engine to enable a fuel feed of the high-pressure fuel stored in the common rail to enter the cylinders. The fuel pump normally includes two plungers, and these plungers are caused to move reciprocally by drive cams provided as separate units at the camshaft to supply pressurized fuel to the common rail. In a standard common rail system through which fuel is fed to, for instance, a six-cylinder engine by employing two plungers, three cam lobes are provided over constant intervals at each of the drive cams that drive the individual plungers. The phases of the drive cams are offset from each other by 60° so as to achieve six injections by allowing the plungers alternately to make three reciprocal movements as the camshaft rotates over 360° once, as disclosed in Patent Official Gazette No. 2797745.

As is understood from the cam lift characteristics and the shape of the cams described in the publication, a fuel pump such as the one described above normally assumes the shape shown in FIG. 7(A). Namely, cam lobes formed at the individual drive cams $\alpha$ and $\beta$ are each formed to achieve a shape having portions used for a forward stroke. (i.e., movement from bottom dead center to top dead center) and a backward stroke (i.e., movement from top dead center to bottom dead center) of the corresponding plunger, and the shapes are symmetrical with respect to each other so that each drive cam takes on a triangular shape overall.

As a result, the lift characteristics manifesting at each of the plungers driven by the drive cams $\alpha$ and $\beta$ during the forward stroke, in which the plunger travels from the bottom dead center to the top dead center, (i.e., away from the center of rotation of the drive cams) and the lift characteristics manifesting at the same plunger during the backward stroke, in which the plunger travels from the top dead center to the bottom dead center (i.e., toward the center of rotation of the drive cams) are symmetrical. In addition, the lift characteristics of one of the plungers manifest as sine waves whose phase is offset by 60° from the sine waves representing the lift characteristics of the other plunger, as shown in FIG. 7(B). Since one of the plungers first ascends from the bottom dead center to the top dead center and completes an injection, and then the other plunger starts ascending from the bottom dead center in the structure of the related art described above, the geometric injection rate (GIR) achieves characteristics whereby the value of the geometric injection rate continuously changes between 0 and the peak value every 60° of the cam rotating angle (cam angle), as shown in FIG. 7(C). Since the cam speed and the drive torque are roughly in proportion to the characteristics of the geometric injection rate, the plunger lift speed (i.e., the cam speed) and the drive torque, too, manifest characteristics whereby they fluctuate in a similar manner.

While a fuel pump having the symmetrical cams described above is normally utilized in an injection pump employed in a common rail system in the related art, a number of problems discussed below arise with regard to a fuel feeding device that employs such a fuel pump.

Namely, if the drive cams illustrated in FIG. 7(A) are utilized, the geometric injection rate (GIR) constantly fluctuates between 0 and the peak value over every 60°, causing a significant fluctuation in the pressure within the common rail. In addition, since the plunger must be lifted to the highest lift position while rotating the drive cam by 60°, the fluctuation in the cam speed, too, is bound to be great, which, in turn, requires a large drive torque.

Furthermore, since the plunger must be lifted to the highest lift position over a small cam rotating angle (60° in the example described above), it becomes necessary to form the cam nose with a small radius of curvature. This results in a large force being applied onto the cam surface while lifting the plunger, so that the surface pressure becomes a problem.

When the fuel pump in the prior art with the problems discussed above is utilized in a common rail system, the range of application in engines becomes limited, and the durability of the overall system is lowered.

Namely, while the pressure-withstanding performance of the product is normally designed to provide an ample margin to comfortably tolerate even the upper limit of the pressure fluctuation to maximize the service life of the product, the pressure-withstanding level of the overall system, including the fuel injection valves, the common rail, the piping connecting the fuel pump with the common rail, and the piping connecting the common rail with the fuel injection valves must be extremely high if the fluctuation of the pressure of the fuel let out from the fuel pump is great. For this reason, a significant fluctuation in the pressure gives rise to problems in that the weight of the product is bound to increase since the components need greater wall thickness, and in that the structure of the product becomes more complicated in order to achieve better pressure-withstanding performance.

In addition, since ignitions normally occur over irregular intervals in the engine combustion chamber of an engine having 10 or more cylinders, the timing with which the fuel is injection into the engine and the timing with which the fuel is fed from the fuel pump to the common rail cannot match each other if a fuel pump having drive cams corresponding to 6 cylinders is used as a replacement in conjunction with such an engine in which ignitions occur over irregular intervals. As a result, if the injection rate of the fuel pump fluctuates greatly, as illustrated in FIG. 7(C), inconsistency occurs between the injection characteristics manifesting as the fuel is injected from a fuel injection valve while the injection rate is low and the injection characteristics manifesting as the fuel is injected while the injection rate is high. For this reason, the injection pump in the prior art and a fuel feeding device that utilizes the injection pump cannot be employed in conjunction with engines in which ignitions occur over irregular intervals.

It is conceivable to increase the number of cam lobes in correspondence to a larger number of cylinders provided in the engine, or to increase the numbers of plungers and drive cams if the first option is not feasible, in order to solve the problem. However, it is difficult to secure a sufficient angle range for forming each cam lobe when the number of cam lobes formed at the drive cams is increased. Accordingly, it becomes necessary to increase the diameter of the drive cams to achieve the required lift quantity, or to increase the wall thickness of the drive cams to withstand the pressure applied to the cam surfaces. Thus, the dimension of the camshaft along the radial direction increases if the diameter of the drive cams is increased, or the dimension of the camshaft along the axial direction increases if the wall thickness of the drive cams is increased. Furthermore, the dimension of the camshaft along the axial direction increases instead when the numbers of plungers and drive cams are increased.

Moreover, when the drive cams in the related art described above are utilized, the drive torque constantly fluctuates between 0 and the peak valve. As a result, the load on the drive system and the noise occurring in the system are bound to be significant. In addition, the product must be designed by adopting a structure with ample margin for drive torque fluctuations, so that the drive system must be thick and heavy to tolerate such drive torque fluctuations.

Accordingly, an object of the present invention is to provide a fuel pump having drive cams with which the problems discussed above can be solved and a fuel feeding device utilizing the fuel pump.

SUMMARY OF THE INVENTION

In order to achieve the object described above, the fuel pump according to the present invention comprises a plurality of plungers and a camshaft having a plurality of drive cams each corresponding to one of the plurality of plungers with a motive force applied from the outside used to rotate the camshaft so that the plurality of plungers engage the corresponding drive cams in reciprocal movement and the fuel pressurized and force-fed during a forward stroke of each of the plungers. All or some of the plurality of drive cams are set by offsetting their phases from one another, and each of the drive cams includes asymmetrical cam lobes each formed so as to reduce the extent of displacement of the corresponding plunger relative to a unit cam rotating angle during the forward stroke (i.e., motion from top dead center to bottom dead center) compared to the extent of displacement occurring during the backward stroke of the plunger.

In addition, the fuel feeding device according to the present invention has a fuel pump, a common rail in which high-pressure fuel force-fed from the fuel pump is stored, and fuel injection valves each provided in correspondence to one of the cylinders of an internal combustion engine which allow the high-pressure fuel stored in the common rail to be fed. The fuel pump comprises a plurality of plungers and a camshaft having a plurality of drive cams each provided in correspondence to one of the plurality of plungers. A motive force is applied from the outside and used to rotate the camshaft to engage the plurality of plungers in reciprocal movement with the corresponding drive cams and the fuel pressurized and force-fed during a forward stroke of each of the plungers. All or some of the plurality of drive cams are set by offsetting their phases from one another, and each of the drive cams includes asymmetrical cam lobes each formed so as to reduce the extent of displacement of the corresponding plunger relative to a unit cam rotating angle during the forward stroke compared to the extent of displacement occurring during the backward stroke of the plunger.

Thus, by utilizing the fuel pump having the drive cams described above, in which the extent of the displacement of each plunger per unit of cam rotating angle (i.e., the extent of change in the lift) is reduced during the forward stroke of the plunger than the extent of plunger displacement occurring during the backward stroke of the plunger, the plunger can be lifted more slowly compared to the prior art during the forward stroke, and the plunger can also be reset quickly during the backward stroke even if the number of cam lobes provided at each drive cam is the same as that in the related art. As a result, the geometric injection rate of the fuel pump and the maximum drive torque, which is in proportion to the geometric injection rate, can be set smaller than in a structure utilizing the symmetrical cams in the related art.

Furthermore, even if the cam rotating angle allocated in correspondence to each cam lobe is small, the cam lobes assume an asymmetrical shape whereby the extent of plunger displacement relative to the unit cam rotating angle is smaller during the forward stroke than in the backward stroke. As a result, it is possible to achieve a larger radius of curvature at the cam nose than in the prior art.

It is desirable to form the cam lobes at the drive cams so that they assume a concave shape over the areas corresponding to the backward stroke of the plungers.

By forming the drive cams in such a shape, the angle range of the portion of each of the drive cams required for the backward stroke can be further reduced so as to assure a larger angle range of the portion of each of the drive cams allocated for the forward stroke while ensuring that the plungers move along the backward direction quickly. While it goes without saying that the portion of each cam lobe corresponding to the backward stroke should be formed over an angle range (i.e., an angle of an arc spanning a portion of each drive cam) in which jumping of the plunger or the tappet provided between the plunger and the cam lobe is prevented, the shape described above is particularly effective when a large number of cam lobes are formed with a small angle range allocated for each cam lobe. Thus, it is necessary to lift the plungers slowly by maximizing the angle range corresponding to the forward stroke.

It is desirable that the asymmetrical cam lobes be formed at the plurality of drive cams so that the injection rates of the individual plungers achieve a roughly constant total over a given cam rotating angle.

The cam lobes at the drive cams are formed in an asymmetrical shape whereby the extent of change in the plunger lift per unit cam rotating angle is smaller during the forward stroke than the extent of change manifesting during the backward stroke of the plungers so as to ensure that an almost constant total is achieved by the injection rates of the individual plungers over a given cam rotating angle. Therefore, it is no longer necessary to synchronize the reciprocal movement of the plungers with engine ignitions even when the fuel pump is utilized in conjunction with an engine in which ignitions occur over irregular intervals. In other words, when this fuel pump is utilized in a common rail system, the quantity of fuel fed to the common rail hardly fluctuates and, as a result, the extent of pressure fluctuation occurring within the common rail can be lessened. Thus, no significant disruption occurs in the injection characteristics even if the system is employed in conjunction with an engine in which ignitions occur over irregular intervals.

BRIEF DESCRIPTION OF THE DRAWINGS

FIG. 5 illustrates an example of drive cams used in the fuel pump according to the present invention and characteristics achieved by utilizing these drive cams, in which FIG. 5(A) is a schematic view showing the shape of the drive cams viewed along the axial direction, FIG. 5(B) is a diagram of characteristics representing the change in the plunger lift relative to the cain rotating angle, and FIG. 5(C) is a diagram of characteristics representing the geometric injection rate relative to the cam rotating angle;

FIG. 6 illustrates another example of drive cams that may be used in the fuel pump according to the present invention and characteristics achieved by utilizing these drive cams, in which FIG. 6(A) is a schematic view showing the shape of the drive cams viewed along the axial direction, FIG. 6(B) is a diagram of characteristics representing the change in the plunger lift relative to the cam rotating angle, and FIG. 6(C) is a diagram of characteristics representing the geometric injection rate relative to the cam rotating angle; and FIG. 7 illustrates drive cams used in a fuel pump in the related art and characteristics achieved by utilizing these drive cams, in which FIG. 7(A) is a schematic view showing the shape of the drive cams viewed along the axial direction, FIG. 7(B) is a diagram of characteristics representing the change in the plunger lift relative to the cam rotating angle, and FIG. 7(C) is a diagram of characteristics representing the geometric injection rate relative to the cam rotating angle.

DETAILED DESCRIPTION OF THE INVENTION

Figure 1:
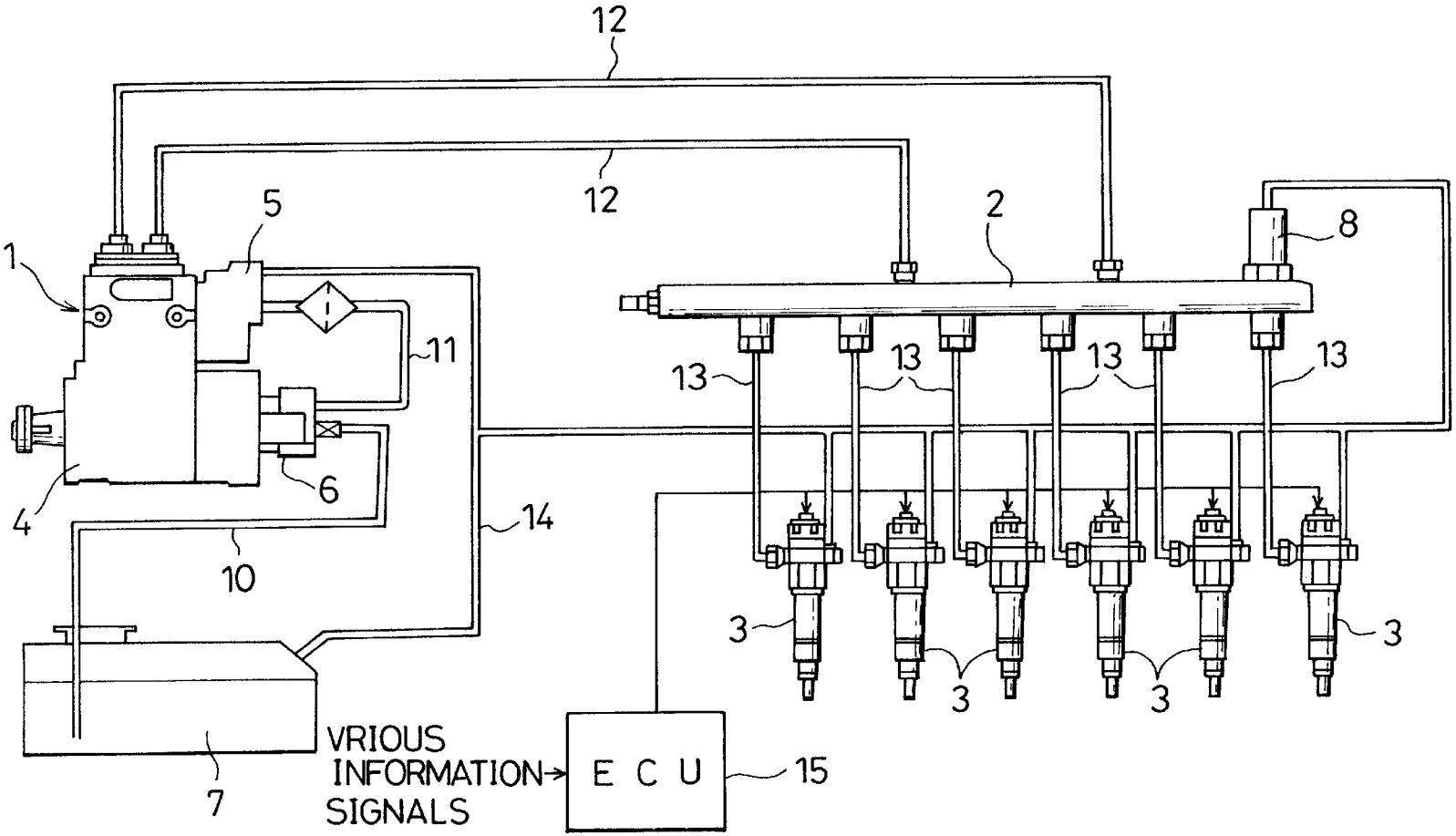
FIG. 1 shows the overall structure of a pressure-accumulator type fuel feeding device.

The following is an explanation of the preferred embodiments of the present invention, given with reference to the drawings. In FIG. 1 showing the overall structure assumed in a pressure-accumulator type fuel feeding device referred to as a common rail system, the fuel feeding device comprises a fuel pump 1 that pressurizes and then feeds the pressurized fuel, a common rail (header) 2 in which the fuel is accumulated, and fuel injection valves 3 each corresponding to one of the cylinders of an internal combustion engine.

The fuel pump 1, which includes two plungers to be detailed later, is formed of a supply pump 4, that pressurizes the fuel induced thereto and then force feeds the pressurized fuel, a fuel metering unit (FMU) 5 that adjusts the quantity of fuel oil to be supplied to the supply pump 4 and a feed pump 6 that draws up the fuel and supplies the fuel to the FMU 5. In the fuel feeding device, which includes piping 10 connecting a fuel tank 7 with the feed pump 6, piping 11 connecting the feed pump 6 with the FMU 5, piping 12 connecting the supply pump 4 of the fuel pump 1 with the common rail 2, and piping 13 connecting the common rail 2 with the individual fuel injection valves 3, the fuel oil drawn up from the fuel tank 7 by the feed pump 6 is supplied to the fuel metering unit (FMU) 5 where the quantity of the fuel to be supplied to the supply pump 4 is adjusted. The fuel alternately pressurized by the two plungers is force fed to the common rail 2 and the fuel is then fed to the individual fuel injection valves 3 from the common rail 2.

In addition, the fuel feeding device further includes an overflow valve (not shown) provided at the fuel pump 1, a pressure limiting valve 8 that is provided at the common rail 2 and discharges the fuel oil inside the rail if the fuel oil pressure inside the rail reaches a level equal to or higher than a specific pressure level, and piping 14 that connects the individual fuel outlets communicating with the control chambers (not shown) at the fuel injection valves 3 to the fuel tank 7. Thus, the fuel feeding device that is capable of returning the fuel with its pressure equal to or higher than a specific pressure level, which has been supplied to the supply pump 4 via the FMU 5 from the feed pump 6, to the fuel tank 7, also prevents the pressure inside the common rail from rising excessively by returning the fuel inside the common rail 2 to the fuel tank 7 if the pressure of the fuel inside the common rail 2 rises to a level equal to or higher than a specific pressure level and allows the high-pressure fuel in the control chambers (not shown) at the fuel injection valves 3 to flow out to the fuel tank 7 at an injection start to open the fuel injection valves 3.

The fuel injection valves 3, which engage in operation in response to control signals generated through arithmetic processing executed at an electronic control unit (ECU) 15 based upon various information signals indicating, for instance, the engine rotation rate and the like detected at various sensors and switches (not shown), inject the high-pressure fuel inside the common rail with optimal injection timing at an optimal injection quantity.

Figure 2:
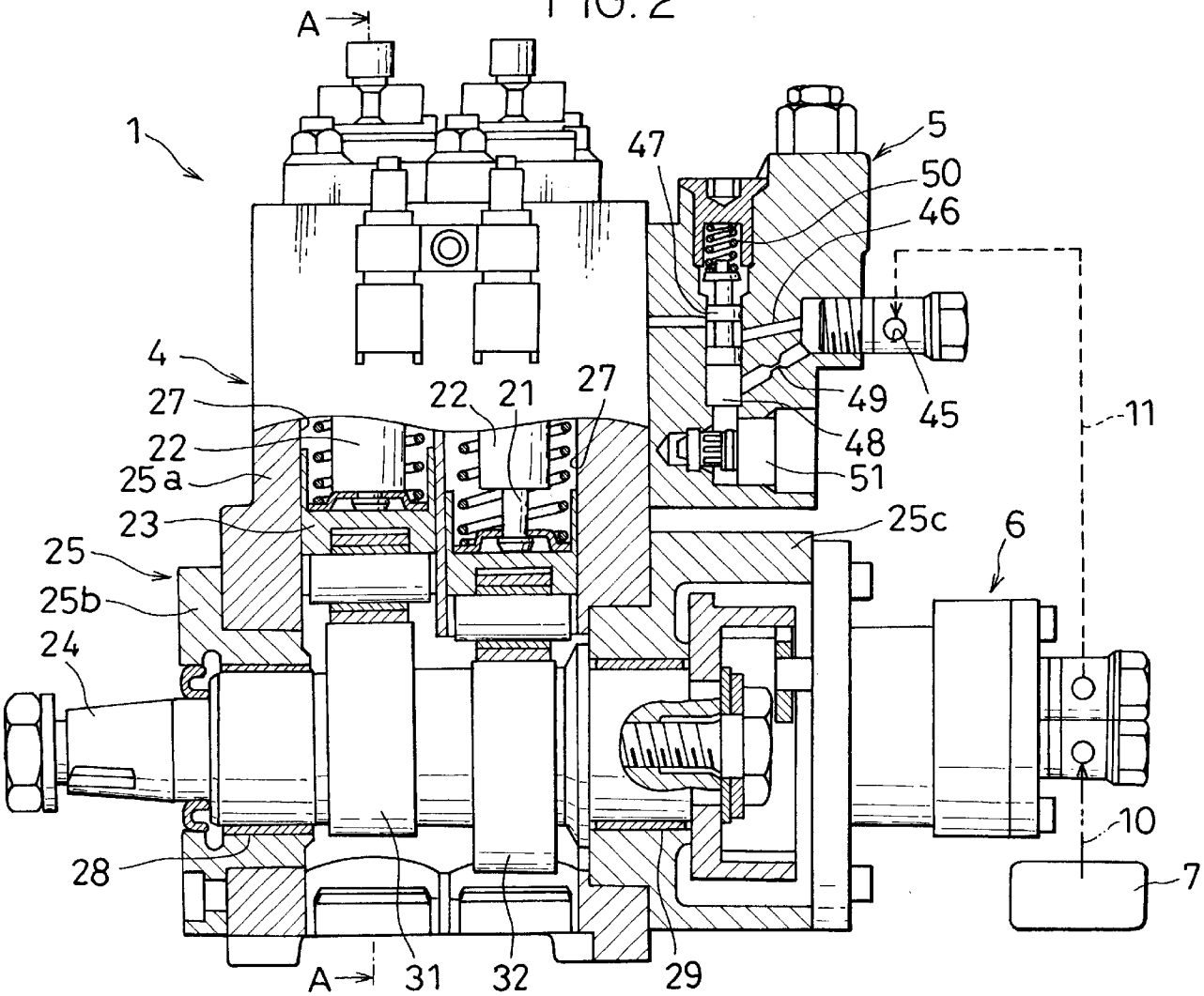
FIG. 2 is a partially notched sectional view of the fuel pump utilized in the pressure-accumulator type fuel feeding device shown in FIG. 1.
Figure 3:
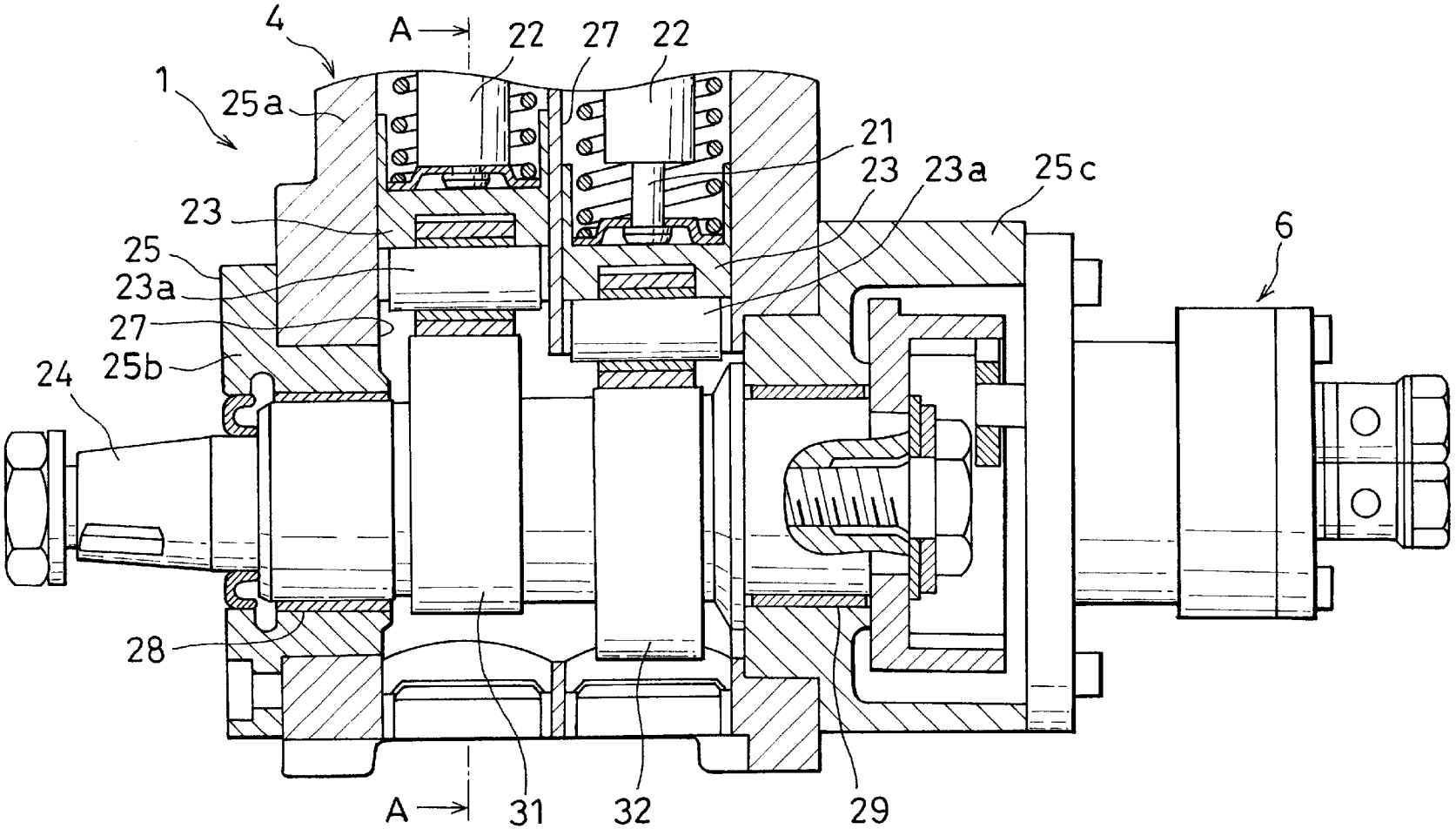
FIG. 3 is an enlargement of the camshaft in the fuel pump shown in FIG. 2.
Figure 4:
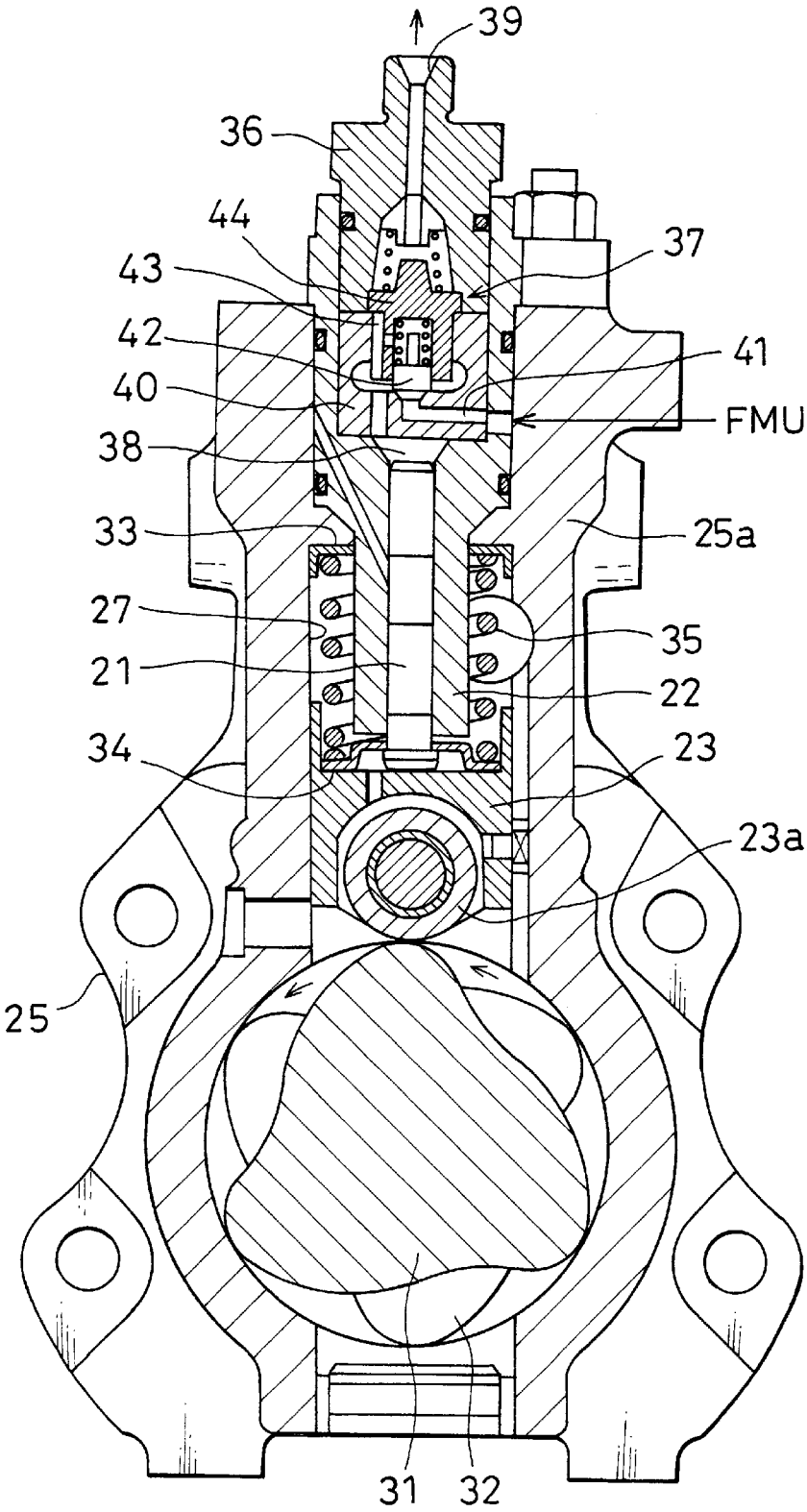
FIG. 4 is a sectional view taken along line A—A in FIG. 2 and FIG. 3.

FIGS. 2 through 4 show the fuel pump described above. The supply pump 4 constituting a part of the fuel pump 1 includes plungers 21, plunger barrels 22, tappets 23, and a camshaft 24. The camshaft 24, which is supported by a pump housing 25, receives a drive torque from an engine (not shown) at one end thereof projecting out to the outside through the pump housing 25 so as to rotate in synchronization with the engine.

The pump housing 25 is constituted of a housing member 25*a* having longitudinal holes 27 at which the plunger barrels 22 are mounted, and housing members 25*b* and 25*c* that are secured to the housing member 25*a* with bolts or the like and rotatably hold the camshaft 24 near the two ends of the camshaft 24.

In this example, two longitudinal holes 27 are formed in the housing member 25*a*, with the plunger barrels 22 secured to the housing member 25*a* inside the individual longitudinal holes and the plungers 21 inserted at the plunger barrels 22 so as to be allowed to make reciprocal movement freely.

In addition, the camshaft 24 is supported by the housing members 25*b* and 25*c* near its two ends via radial bearings 28 and 29 so as to allow play along the axial direction of the camshaft. At the camshaft 24, two drive cams 31 and 32 are formed between the bearings, at phases offset from each other, each in correspondence to one of the plungers.

The lower ends of the plungers 21 are placed in contact with the tappets 23, and tappet rollers 23*a* are held in contact with the drive cams 31 and 32. Springs 35 are provided between spring receptacles 33 in the housing member 25*a* and spring receptacles 34 located at the bottom of the plungers 21. Thus, as the camshaft 24 rotates, the plungers 21 reciprocate along the contours of the drive cams 31 and 32 in cooperation with the springs 35.

Above each plunger barrel 22, an IO valve (inlet/outlet valve) 37 is mounted between the plunger barrel and a delivery valve holder 36. Between the IO valve 37 and the plunger 21, a plunger chamber 38 is formed, with a fuel outlet 39 formed at the delivery valve holder 36 provided above the IO valve 37.

The IO valve 37, which has a function of feeding the fuel oil supplied from the fuel metering unit (FMU) 5 to be detailed later, to the plunger chamber 38 and discharging the fuel compressed by the plunger 21 through the fuel outlet 39 so as to prevent the fuel from flowing back to the FMU 5, comprises a valve body 40 mounted at the top of plunger barrel 22, an inlet valve 42 that opens/closes a fuel passage 41 having one end thereof communicating with the FMU 5 and another end thereof communicating with the plunger chamber 38 and formed at the valve body 40 and which applies a constant force to the fuel passage 1 along the closing direction by using the force against the pressure of the fuel from the FMU 5, and an outlet valve 44 that opens/closes a fuel passage 43 having one end thereof communicating with the plunger chamber 38 and another end thereof communicating with the fuel outlet 39 and which applies a constant force to the fuel passage 43 along the closing direction by utilizing the force against the pressure of the fuel from the plunger chamber 38. As the plunger 21 begins to descend, the outlet valve 44 closes to allow the fuel from the FMU 5 to push up the inlet valve 42 so that the fuel flows into the plunger chamber 38. When the plunger 21 ascends, the pressurized fuel closes the inlet valve 42 thereby pushing up the outlet valve 44 and, as a result, the fuel is force fed through the fuel outlet 39.

In addition, the fuel metering unit (FMU) 5 of the fuel pump delivers the fuel supplied from the feed pump 6 to the IO valves 37 after adjusting the fuel quantity so as to achieve the fuel pressure required in the engine. It includes throttle valves 47 each provided in the middle of a fuel passage 46 through which the fuel supplied from the feed pump 6 is guided to the IO valve 37 provided in conjunction with each plunger. By supplying the fuel received from the feed pump 6 to a pressure chamber 48 provided at one end of each throttle valve 47 via an orifice 49, stopping throttle valve 47 at a position at which the pressure the pressure chamber 48 and the spring force imparted by a spring 50 provided at another end of the throttle valve 47 are in balance, and adjusting the pressure in the 48 through an electromagnetic valve 51 which is controlled by the electronic control unit (ECU) 15, the constriction of the 46 is controlled to adjust the quantity of the fuel to be supplied to the IO valve 37.

The feed pump 6 of the fuel pump, which draws up the fuel from the fuel tank 7 and feeds the fuel to the fuel metering unit (FMU) 5, is mounted with bolts or the like so as to close off the opening formed at the housing member 25*c* of the pump housing 25. The feed pump 6 draws up the fuel from the fuel tank 7 by utilizing a gear pump including a main gear and a slave gear (not shown) as the camshaft 24 rotates, and then feeds the fuel to the fuel metering unit (FMU) 5 via a fuel filter (not shown).

The two drive cams 31 and 32 employed in this fuel pump have shapes identical to each other and, as shown in FIG. 5(A), they include cam lobes 31*a* and 32*a* respectively, formed over 120° intervals (i.e., spaced apart 120°). One of the drive cams is set at a phase offset from the phase of the other drive cam by 60° so as to allow the forward stroke of a plunger effected (moved) by one of the drive cams to overlap the backward stroke of the other plunger effected by the second drive cam.

To explain this in further detail, the cam lobes 31*a* and 32*a*, each of which achieves the plunger lift characteristics shown in FIG. 5(B), are each formed to have a forward stroke surface portion for moving a respective plunger from bottom dead center to top dead center (i.e., in a forward direction), and to have a backward stroke surface portion for moving the respective plunger from the top dead center position back to the bottom dead center position (i.e., in a backward direction). These surfaces are shaped so that each cam lobe has an asymmetrical shape (with respect to a top dead center point) so as to reduce the extent of the displacement of the lift of the plunger 21 per unit of cam rotating angle during the forward stroke of the plunger 21 as compared to during the backward stroke of the plunger 21. Namely, the length of time (the cam rotating angle) corresponding to the forward stroke (the ascending process) of the plunger during which the volumetric capacity of the plunger chamber is reduced is greater than the length of time (the cam rotating angle) corresponding to the backward stroke (the descending process) during which the volumetric capacity of the plunger chamber is increased, in order to maximize the angle range of the cam lobes 31*a* and 32*a* utilized for the forward stroke.

In other words, the forward stroke surface portion of each of the cam lobes spans a larger cam angle than the backward stroke surface portion of each of the cam lobes. As shown in FIG. 5(A), the cam lobes 31*a* and 32*a* each have a gentle convex shape over the forward stroke surface portion and assume a concave shape over the backward stroke surface portion. The portion of the cam lobe formed in the concave shape to effect the backward stroke should be formed over the smallest possible cam angle range over which jumping of the plunger or the tappet is prevented. In this embodiment, of the 120° angle range allocated to each of the cam lobes 31*a* and 32*a*, approximately 80° is allocated to be utilized for the forward stroke (i.e., the cam angle of the forward stroke surface portion is approximately 80°) and the remaining 40° is allocated to be used for the backward stroke (i.e., the cam angle of the backward stroke surface portion is approximately 40°). In other words, the ratio of the cam angle of the forward stroke surface portion used for the forward stroke to the cam angle of the backward stroke surface portion used for the backward stroke is about 2 to 1.

Figure 7:
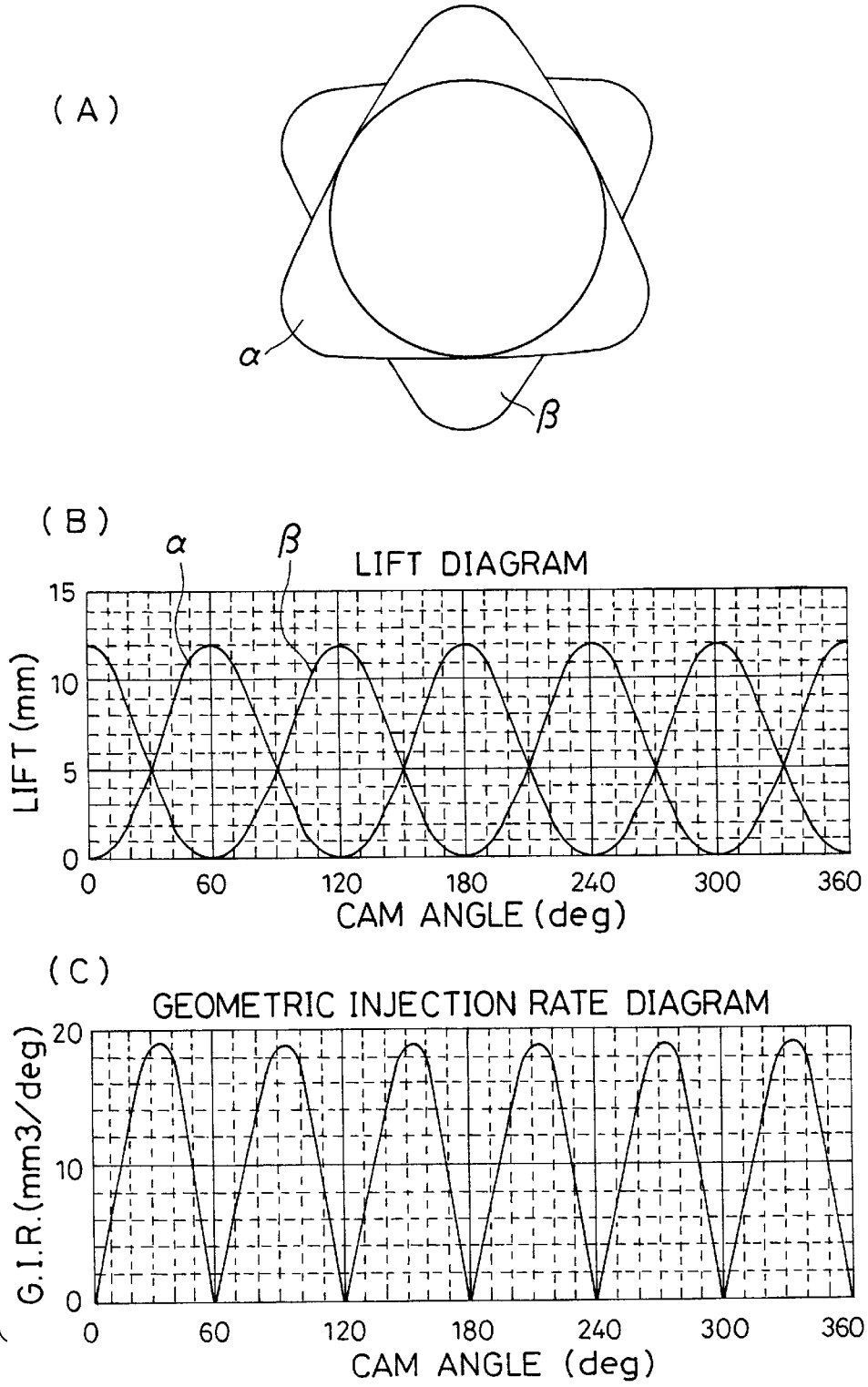

Since the characteristics whereby the extent of displacement of the plungers 21 per unit of cam rotating angle is smaller during the forward stroke of the plungers 21 than during the backward stroke of the plungers 21 are achieved with the drive cams 31 and 32, the cam speed during the forward stroke is lowered to lift the plungers more slowly than in the structure of the prior art illustrated in FIG. 7 having the same number of symmetrical cam lobes. In addition, since the portion of each cam lobe corresponding to the backward stroke is formed in the concave shape, the angle range utilized for the backward stroke is minimized and thus a larger angle range can be allocated for the forward stroke. As a result, as shown in FIG. 5(C), the maximum value of the geometric injection rate (G.I.R.) is reduced compared to the maximum value achieved in conjunction with the symmetrical cams in the prior art and presented in FIG. 7(C).

Consequently, the fluctuation of the injection rate in the fuel pump 1 is lessened compared to the prior art to reduce the extent of the pressure fluctuation occurring at the common rail 2. In addition, since the drive torque changes in proportion to the injection rate, the fluctuation of the drive torque, too, can be reduced compared to the prior art, and as the drive torque is reduced in this manner, the load on the drive system and the noise, too, can be reduced.

Furthermore, since the length of time elapsing before each plunger 21 reaches its highest lift position is increased (a large cam rotating angle is assumed over the forward stroke), the radius of curvature of the cam nose is increased. This, in turn, reduces the force applied to the cam surface. Thus, the tappet roller 23*a* no longer needs to have a large diameter, which ultimately achieves overall miniaturization of the pump.

In addition, the cam lobes 31*a* and 32*a* of the drive cams 31 and 32, respectively, shown in FIG. 5(A) are adjusted so as to achieve an almost constant total of the injection rates achieved by the individual plungers 21 relative to the cam rotating angle.

Namely, before the plunger 21 driven by one of the drive cams reaches the peak position (12 mm in this example) and thus the fuel feed is completed, the plunger driven by the other drive cam starts to lift, and this starts a fuel feed. In other words, there is a period over which the fuel is force fed by the two plungers, and by adjusting as appropriate the convex shape of portions of the cam lobes 31*a* and 32*a* that effect the forward stroke and the concave shape of the portions that effect the backward stroke, the composite injection rate (the composite speed) of the two plungers corresponding to a full rotation of the camshaft 24 and a 360° rotation of each drive cam, i.e., the total of the injection rates relative to the cam rotating angle, can be sustained at an almost constant level as indicated by the bold line in FIG. 5(C).

In this example, the lift start point for one of the plungers is set ahead of the time point at which the other plunger reaches the highest lift position by an approximately 20° cam rotating angle.

As a result, the injection pump 1 having drive cams 31 and 32 allows the plungers 21 to ascend slowly during the forward stroke. Thus, the radius of curvature of the cam nose can be increased compared to that of the symmetrical cams shown in FIG. 7(A) to achieve an added advantage of reduced pressure applied to the surfaces of the drive cams. In other words, by forming the portions of the cam lobes corresponding to the forward stroke in a gentle convex shape, the contact pressure at the areas where the tappet rollers 23*a* and the drive cams 31 and 32 come into contact with each other can be kept down (the level of the force imparted from the tappet rollers 23*a* onto the cam surfaces can be kept down). Since this eliminates the necessity to allow a large diameter at the tappet rollers 23*a* to withstand a high surface pressure at the cam surfaces, the diameter of the tappet rollers 23*a* can be reduced.

Furthermore, since the portions of the cam lobes corresponding to the backward stroke are formed in a concave shape, the angle range allocated for the backward stroke can be reduced, which allows the plungers to be lifted slowly by minimizing the cam speed during the forward stroke and also allows the plungers to make a quick backward movement during the backward moving stroke. In other words, a larger angle range can be allocated for the forward stroke by forming the portions of the cam lobes corresponding to the backward stroke in a concave shape to eliminate the necessity to lift the plungers fast (i.e., the cam speed and ultimately, the drive torque, too, can be reduced).

Since a constant quantity of fuel is delivered from the injection pump 1 in the fuel feeding device shown in FIG. 1 employing the injection pump 1 described above, the extent of pressure fluctuation occurring inside the common rail 2 is reduced.

Thus, even when the product is designed to achieve high pressure-withstanding performance with a sufficient margin to comfortably tolerate the upper limit of the pressure fluctuation to prolong the service life of the product, the pressure-withstanding level for the entire system including the fuel injection valves, the common rail 2 and the piping 12 can be lowered since the extent of the pressure fluctuation itself is minimized. Since this, in turn, allows the components to have smaller wall thicknesses, a reduction in the weight of the product is achieved and the product does not need to assume a complicated structure to assure high pressure-withstanding performance either. If, on the other hand, the system is designed to have a level of pressure-withstanding performance comparable to that of the prior art, the level of the fuel injection pressure can be raised.

In addition, even when the fuel pump 1 described above is utilized in conjunction with an engine in which ignitions occur over irregular intervals, the problem of the timing of the fuel injection into the engine and the timing of the fuel feed from the fuel pump 1 to the common rail 2 not matching each other is eliminated. Namely, since the composite injection rate at the fuel pump 1 is sustained at an almost constant level relative to the cam rotating angle, as illustrated in FIG. 6(C), stable injection characteristics can be achieved unaffected by the timing with which the fuel is fed from the fuel pump by minimizing the extent of the pressure fluctuation within the common rail even when the total number of cam lobes 31*a* and 32*a* at the two drive cams 31 and 32 do not match the number of cylinders in the engine. In other words, an asynchronous operation that is not affected by the engine combustion timing allows the fuel pump 1 and the fuel feeding device to be utilized in conjunction with an engine in which ignitions occur over irregular intervals.

Furthermore, since it is not necessary to increase the number of cam lobes at the drive cams 31 and 32 and the number of plungers 21 to support an engine with a larger number of cylinders, the drive cams can remain small both in diameter and in thickness, and it is not necessary to increase the dimension of the camshaft 24 along the axial direction to accommodate a larger number of drive cams. As a result, a more compact injection pump 1 and, ultimately, a more compact fuel feeding device are achieved.

Figure 6:
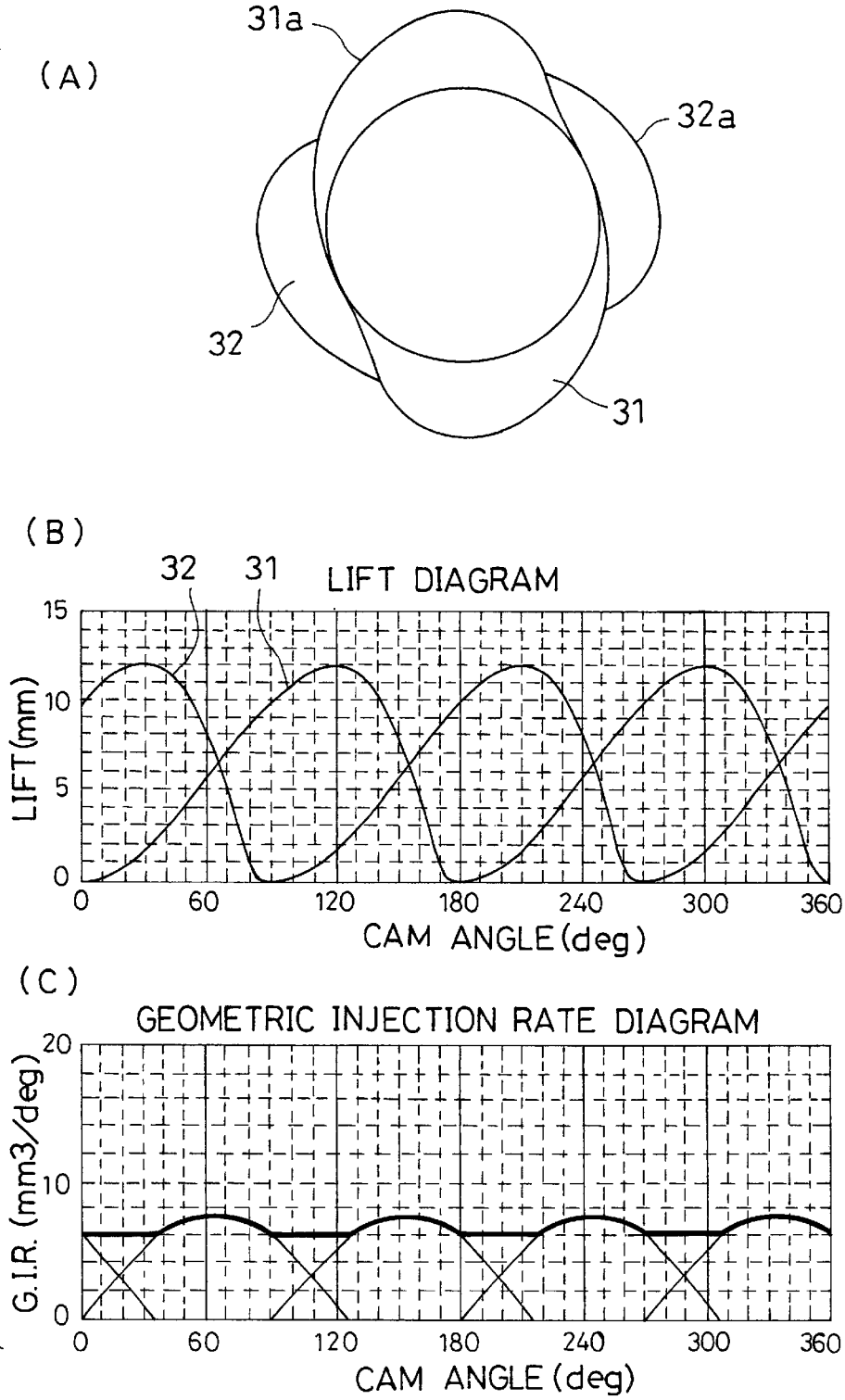

In another example of the drive cams 31 and 32 presented in FIG. 6, cam lobes 31*a* and 32*a* are formed on the individual drive cams over 180° intervals. One drive cam is set at a phase offset from the phase of the other drive cam by 90°, and the forward stroke of the plunger effected by one of the drive cams is allowed to partially overlap the forward stroke of the plunger effected by the other drive cam.

The cam lobes 31*a* and 32*a* each achieve the plunger lift characteristics shown in FIG. 6(B), and the cam lobes 31*a* and 32*a* provided at the drive cams 31 and 32 respectively are each formed in an asymmetrical shape so as to reduce the extent of the displacement of the lift of the corresponding plunger 21 per unit of cam rotating angle during the forward stroke compared to during the backward stroke of the plunger 21, as in the previous example. Namely, the length of time (the cam rotating angle) corresponding to the forward stroke (the ascending process) of the plunger during which the volumetric capacity of the plunger chamber is reduced is set larger than the length of time (the cam rotating angle) corresponding to the backward stroke (the descending process) during which the volumetric capacity of the plunger chamber is increased, in order to maximize the angle range of the cam lobes 31*a* and 32*a* utilized for the forward stroke. As shown in FIG. 6(A), the cam lobes 31*a* and 32*a* each take on a gentle convex shape over the forward stroke and assume a concave shape over the backward stroke.

In this example, too, the portions of the cam lobes formed in the concave shape to effect the backward stroke should be formed over the smallest possible angle range over which jumping of the plunger or the tappet is prevented.

In addition, the forward stroke of the plunger effected by one of the drive cams starts before the plunger driven by the other drive cam reaches the peak position. In other words, before the fuel feed by the plunger driven by the one drive cam is completed, the fuel feed by the plunger driven by the other drive cam starts, and the composite injection rate (the composite speed) of the two plungers corresponding to a full rotation of the camshaft 24 and a 360° rotation of each drive cam (i.e., the total of the injection rates of the two plungers relative to the cam rotating angle) can be sustained at an almost constant level as indicated by the bold line in FIG. 6(C).

Figure 5:
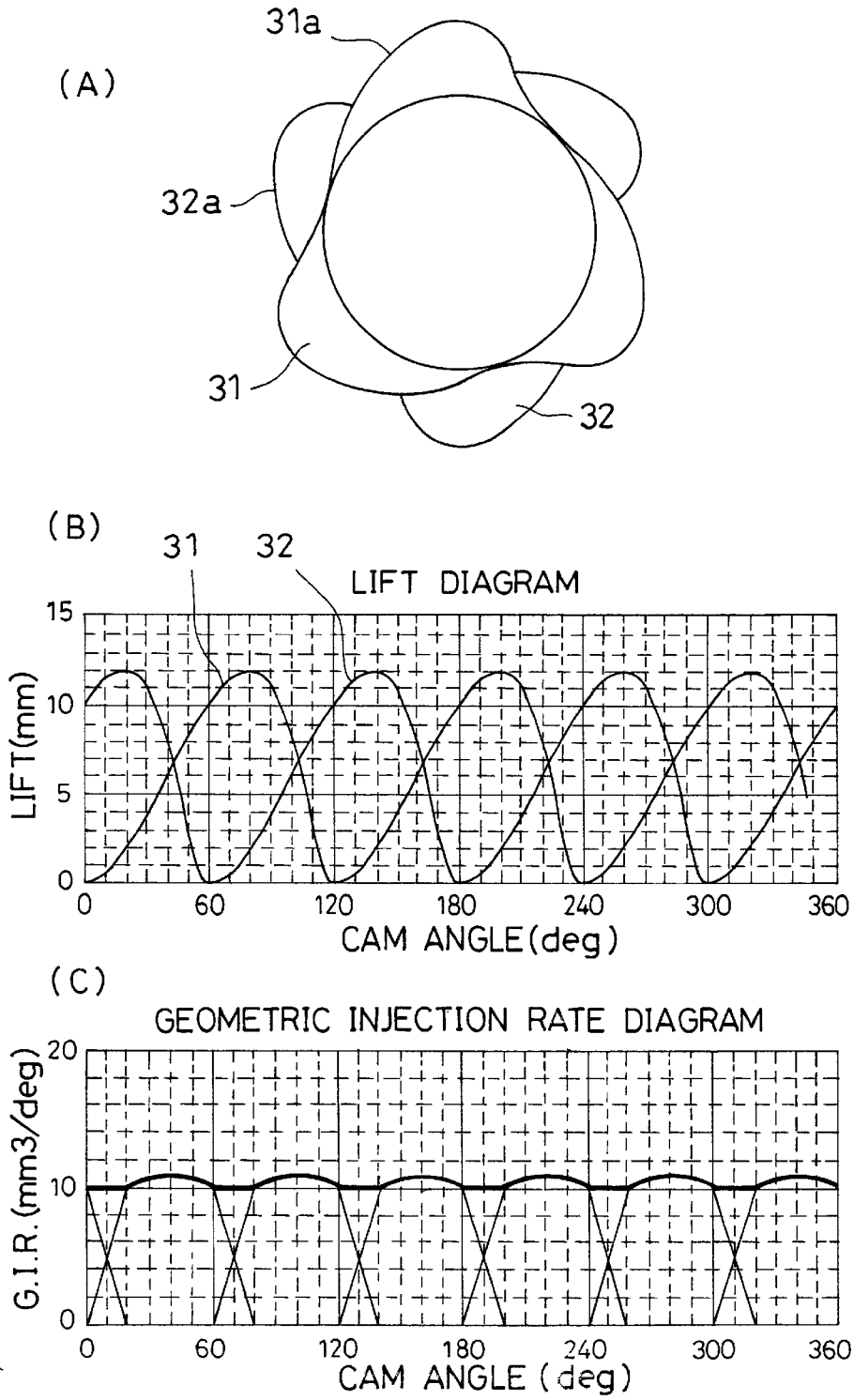

In this embodiment, approximately 120° of the 180° angle range allocated to each of the cam lobes 31*a* and 32*a* is used for the forward stroke and the remaining 60° is used for the backward stroke. In addition, the point in time at which one of the plungers starts to lift is set ahead of the point in time at which the other plunger reaches the highest lift point by a 30° cam rotating angle. Thus, an almost constant geometric fuel injection rate, which is even lower than that achieved by the drive cams shown in FIG. 5, is realized in the overall fuel pump to minimize the extent of pressure fluctuation occurring inside the common rail.

It is to be noted that the other structural features are identical to those in the previous example Accordingly, the same reference numerals are assigned to identical components to preclude the necessity for a repeated explanation thereof.

Thus, the injection pump 1 having these drive cams 31 and 32 also achieves advantages similar to those realized in the previous example. Namely, since each plunger 21 is allowed to ascend slowly during the forward stroke, the radius of curvature of the cam nose can be increased compared to that in the symmetrical cams shown in FIG. 7(A). For this reason, the tappet rollers 23*a* are allowed to have a smaller diameter, as in the previous example. In addition, since the portions of the cam lobes corresponding to the backward stroke are formed in a concave shape, the angle range allocated for the backward stroke can be reduced. This, in turn, allows the largest possible angle range to be set for the forward stroke to lift the plungers slowly and to move the plungers quickly during the backward stroke, which, ultimately, allows the drive torque to be reduced.

Furthermore, since a constant quantity of fuel is delivered from the injection pump 1 in the fuel feeding device shown in FIG. 1 utilizing the injection pump 1 described above, the extent of pressure fluctuation occurring inside the common rail 2 is reduced. As a result, the pressure-withstanding level for the entire system including the fuel injection valves, the common rail 2 and the piping 12 can be lowered, which, in turn, allows the components to have smaller wall thicknesses to achieve a reduction in the product weight, and also allows the required pressure-withstanding level to be lowered to achieve structural simplification. By setting a pressure-withstanding level comparable to that in the prior art for the system, on the other hand, the fuel injection pressure can be raised.

Moreover, the fuel feeding device employing the fuel pump 1 described above can be used in conjunction with an engine in which ignitions occur over irregular intervals, without having to increase the number of cam lobes at the drive cams 31 and 32 and the number of plungers 21 to support an engine with a larger number of cylinders. As a result, the drive cams can remain small both in diameter and thickness, and the dimension of the camshaft 24 along the axial direction does not need to increase to accommodate a larger number of drive cams, to thereby achieve miniaturization of the injection pump and, ultimately, miniaturization of the fuel feeding device.

INDUSTRIAL APPLICABILITY

As described above, the fuel pump according to the present invention comprises a plurality of plungers and a camshaft having a plurality of drive cams each corresponding to one of the plurality of plungers with all or some of the plurality of drive cams set at phases offset from one another. The cam lobes formed at the individual drive cams have an asymmetrical shape so as to reduce the extent of displacement of the lift of the plungers per unit of cam rotating angle during a forward stroke of the plungers compared to the extent of the lift displacement occurring during the backward stroke of the plungers. Thus, the plungers are allowed to lift more slowly than in the prior art during the forward stroke and the plungers are able to move backward quickly during the backward stroke even if the angle range allocated to each cam lobe is small. As a result, even when the drive cams each have the same number of cam lobes as in the prior art, a smaller geometric injection rate and a smaller maximum drive torque value compared to the prior art can be achieved.

Thus, in a fuel feeding device using such a fuel pump to store in the common rail the high-pressure fuel force-fed from the fuel pump and to feed the high-pressure fuel from the common rail to the fuel injection valves each corresponding to one of the cylinders of the internal combustion engine, the fluctuation of the injection rate of the fuel from the injection pump is lessened to reduce the extent of pressure fluctuation occurring in the common rail.

As a result, even when the product is designed to achieve high pressure-withstanding performance with a sufficient margin to comfortably tolerate the upper limit of the pressure fluctuation to prolong the service life of the product, the pressure-withstanding level for the entire system including the fuel injection valves, the common rail and the pipings can be lowered since the extent of the pressure fluctuation of the fuel let out from the fuel pump is minimized. Since this, in turn, allows the components to have smaller wall thicknesses, a reduction in the weight of the product is achieved, and the product does not need to assume a complicated structure to achieve high pressure-withstanding performance, either. By achieving a level of pressure-withstanding performance for the entire system comparable to the level in the prior art, the reduction in the pressure fluctuation allows the injection pressure to increase.

In addition, by utilizing the fuel feeding device according to the present invention employing such a fuel pump, which reduces the extent of the pressure fluctuation occurring in the common rail, in conjunction with an engine in which ignitions occur over irregular intervals, an asynchronous operation of the fuel pump, not affected by the ignitions in the engine, is enabled and, at the same time, the extent of inconsistency in the injection characteristics is reduced. Thus, a fuel pump and a fuel feeding device suitable for application in an engine in which ignitions occur over irregular intervals can be provided.

Furthermore, since the extent of the injection rate fluctuation and the extent of the pressure fluctuation in the common rail are reduced, it is no longer necessary to increase the number of cam lobes formed on the drive cams of the injection pump to conform to the number of cylinders even when the injection pump is utilized in an engine with a larger number of cylinders. Namely, while the width and the diameter of the drive cams must be increased if the number of cam lobes at the drive cams is increased to support an engine with a larger number of cylinders or when this option is not feasible, the number of plungers and the number of drive cams corresponding to the individual plungers must be increased in the prior art, utilization of the fuel pump according to the present invention eliminates the need to modify the design to conform to the number of cylinders in the engine. As a result, the drive cams can remain small both in diameter and in thickness, and it is not necessary to increase the number of plungers and the number of corresponding drive cams either.

Thus, the dimensions of the camshaft along the radial direction and the axial direction do not need to be increased, and miniaturization of the fuel pump and, ultimately, miniaturization of the fuel feeding device can be realized. Furthermore, a common-purpose injection pump and a common-purpose fuel feeding device that can be used in conjunction with various types of engines are provided.

Moreover, the fuel pump having the drive cams described above reduces the maximum drive torque value to lower the load placed on the drive system and the noise in the drive system. Even when the system is designed by allowing for an ample margin for drive torque fluctuation, the structure of the drive system does not need to become complicated or bulky and heavy.

In addition, even if the same number of cam lobes as that in the prior art are formed on the drive cams, the plungers can be lifted more slowly to the highest lift position over a larger angle range compared to that of the symmetrical cams in the prior art. As a result, the radius of curvature of the cam nose can be increased to achieve the advantage of reduced surface pressure. Namely, the amount the force applied to the cam surfaces is lowered, which allows the diameter of the tappet rollers provided between the drive cams and the plungers to be reduced, thereby enabling miniaturization of the overall fuel pump and, ultimately, miniaturization of the fuel feeding device.

By forming the portions of the cam lobes at the drive cams corresponding to the backward stroke of the plungers in a concave shape, the angle range required for the backward stroke can be further reduced. The adoption of this shape in the cam lobes is particularly effective in achieving the lowest possible lift speed during the forward stroke when a large number of cam lobes are formed and, as a result, the angle range allocated for each cam lobe is small.

By forming asymmetrical cam lobes at the plurality of drive cams so as to achieve an almost constant total of injection rates achieved by the individual plungers relative to the cam rotating angle, a constant quantity of fuel can be delivered from the fuel pump at all times with a high degree of reliability. By using such an injection pump in a common rail system, the extent of pressure fluctuation occurring in the common rail can be further reduced to lessen the inconsistency in the injection characteristics. Consequently, a fuel pump and a fuel feeding device suitable for application in engines in which ignitions occur over irregular intervals are provided.

What is claimed is:

1. A fuel feeding device comprising:

a fuel injection pump including:

a plurality of plunger chambers;

a plurality of plungers operable to reciprocate within said plunger chambers, respectively; and a camshaft having a plurality of drive cams corresponding to said plungers, respectively, said camshaft being rotatable by an exterior motive force so as to rotate said drive cams to thereby reciprocate said plungers within said plunger chambers, each of said drive cams having an equal number of cam lobes, each of said cam lobes having a forward stroke surface portion and a backward stroke surface portion, said forward stroke surface portion spanning a larger cam angle than said backward stroke surface portion;

a common rail for storing fuel force-fed from said fuel injection pump; and a plurality of fuel injection valves corresponding to cylinders of an internal combustion engine, respectively, said fuel injection valves being operable to supply fuel from said common rail to said cylinders, respectively.

2. The fuel injection pump of claim 1, wherein said forward stroke surface portion comprises a convex-shaped surface, and said backward stroke surface portion comprises a concave-shaped surface.

3. The fuel injection pump of claim 2, wherein said forward stroke surface portion comprises only a convex-shaped surface without any concave-shaped surface portions.

4. The fuel injection pump of claim 3, wherein said cam lobes of said drive cams are shaped and arranged so as to generate an almost constant fuel injection rate.

5. The fuel injection pump of claim 4, wherein a size of said cam angle of said forward stroke surface portion is approximately twice as large as a size of said cam angle of said backward stroke surface portion.

6. The fuel injection pump of claim 3, wherein a size of said cam angle of said forward stroke surface portion is approximately twice as large as a size of said cam angle of said backward stroke surface portion.

7. The fuel injection pump of claim 1, wherein said cam lobes of said drive cams are shaped and arranged so as to generate an almost constant fuel injection rate.

8. The fuel injection pump of claim 7, wherein a size of said cam angle of said forward stroke surface portion is approximately twice as large as a size of said cam angle of said backward stroke surface portion.

9. The fuel injection pump of claim 1, wherein a size of said cam angle of said forward stroke surface portion is approximately twice as large as a size of said cam angle of said backward stroke surface portion.

10. A fuel injection pump comprising:

a plurality of plunger chambers;

a plurality of plungers operable to reciprocate within said plunger chambers, respectively; and a camshaft having a plurality of drive cams corresponding to said plungers, respectively, said camshaft being rotatable by an exterior motive force so as to rotate said drive cams to thereby reciprocate said plungers within said plunger chambers, each of said drive cams having an equal number of cam lobes, each of said cam lobes having a forward stroke surface portion and a backward stroke surface portion, said forward stroke surface portion spanning a larger cam angle than said backward stroke surface portion.

11. The fuel injection pump of claim 10, wherein said forward stroke surface portion comprises a convex-shaped surface, and said backward stroke surface portion comprises a concave-shaped surface.

12. The fuel injection pump of claim 11, wherein said forward stroke surface portion comprises only a convex-shaped surface without any concave-shaped surface portions.

13. The fuel injection pump of claim 12, wherein said cam lobes of said drive cams are shaped and arranged so as to generate an almost constant fuel injection rate.

14. The fuel injection pump of claim 13, wherein a size of said cam angle of said forward stroke surface portion is approximately twice as large as a size of said cam angle of said backward stroke surface portion.

15. The fuel injection pump of claim 12, wherein a size of said cam angle of said forward stroke surface portion is approximately twice as large as a size of said cam angle of said backward stroke surface portion.

16. The fuel injection pump of claim 10, wherein said cam lobes of said drive cams are shaped and arranged so as to generate an almost constant fuel injection rate.

17. The fuel injection pump of claim 16, wherein a size of said cam angle of said forward stroke surface portion is approximately twice as large as a size of said cam angle of said backward stroke surface portion.

18. The fuel injection pump of claim 10, wherein a size of said cam angle of said forward stroke surface portion is approximately twice as large as a size of said cam angle of said backward stroke surface portion.

19. The fuel injection pump of claim 10, wherein each of said drive cams has two cam lobes equally spaced apart, each of said drive cams being arranged on said camshaft so as to be offset from an adjacent drive cam by 90°.

20. The fuel injection pump of claim 10, wherein each of said drive cams has three cam lobes equally spaced apart, each of said drive cams being arranged on said camshaft so as to be offset from an adjacent drive cam by 60°.

* * * * *